US008342369B2

(12) United States Patent
Hsu

(10) Patent No.: US 8,342,369 B2
(45) Date of Patent: Jan. 1, 2013

(54) PRESSING STRUCTURE OF SOAP DISPENSER CAPABLE OF ADJUSTING OUTPUT SOAP AMOUNT

(75) Inventor: Chin-Chan Hsu, Rueifang Township, Taipei County (TW)

(73) Assignee: Hokwang Industries Co., Ltd., Taipei County (TW)

( * ) Notice: Subject to any disclaimer, the term of this patent is extended or adjusted under 35 U.S.C. 154(b) by 730 days.

(21) Appl. No.: 12/608,010

(22) Filed: Oct. 29, 2009

(65) Prior Publication Data

US 2011/0101032 A1 May 5, 2011

(51) Int. Cl.
*B65D 88/54* (2006.01)

(52) U.S. Cl. ..... 222/309; 222/333

(58) Field of Classification Search ..... 222/63, 222/182–183, 250, 282, 287, 309, 321.8, 222/325, 333

See application file for complete search history.

(56) References Cited

U.S. PATENT DOCUMENTS

| | | | | |
|---|---|---|---|---|
| 4,273,257 | A * | 6/1981 | Smith et al. | 222/43 |
| 5,062,547 | A * | 11/1991 | Zahner et al. | 222/144.5 |
| 5,263,611 | A * | 11/1993 | Trippen | 222/105 |
| 5,305,916 | A * | 4/1994 | Suzuki et al. | 222/52 |
| 5,823,390 | A * | 10/1998 | Muderlak et al. | 222/38 |
| 2005/0072808 | A1 * | 4/2005 | Kitamura | 222/309 |
| 2009/0261124 | A1 * | 10/2009 | Boll et al. | 222/180 |

FOREIGN PATENT DOCUMENTS

| | | |
|---|---|---|
| TW | 367979 | 8/1999 |
| TW | M328853 | 3/2008 |
| TW | M335262 | 7/2008 |
| TW | M345577 | 12/2008 |

* cited by examiner

*Primary Examiner* — Kevin P Shaver
*Assistant Examiner* — Andrew P Bainbridge
(74) *Attorney, Agent, or Firm* — Muncy, Geissler, Olds & Lowe, PLLC

(57) ABSTRACT

The present invention provides a pressing structure of a soap dispenser for adjusting an output amount of the soap by adjusting the distance of a pressing stroke thereof. The pressing structure includes a rejecting member, a driving device, and a moving member, wherein the driving device is connected to the moving member through a transmission mechanism, and the rejecting member includes a connecting portion linked with the moving member, and a pressing plate against a pressing head of a liquid container, characterized in that the rejecting member further includes a retractable portion used for adjusting the vertical distance between the connecting portion and the pressing plate. Accordingly, through adjusting the vertical distance by the retractable portion, the vertical moving distance of a pressing head of a liquid container achieved by the pressing plate can therefore be decided, so as to output a suitable amount of soap.

6 Claims, 9 Drawing Sheets

PRESSING STRUCTURE OF SOAP DISPENSER CAPABLE OF ADJUSTING OUTPUT SOAP AMOUNT

FIELD OF THE INVENTION

The present invention is related to a pressing structure of a soap dispenser capable of adjusting the output amount of the soap, and more particularly to a pressing structure of a soap dispenser which determines the output soap amount by adjusting the distance of a pressing stroke thereof.

BACKGROUND OF THE INVENTION

Various kinds of electronic sensing technologies have applied to our daily life to bring in the convenience, especially for sanitary equipment.

For example, in the public places, such as, the toilets in the park, hospital, or station, people share the sanitary equipments, such as, the faucet, the soap dispenser, and the flush button, with others which not only reduces the lifetime of the equipments, but the sanitary conditions becomes worse. Besides, the physical contacts of the users' hands with these public equipments also increase the possibility of infection. Then, by introducing the electronic sensing technology, the modern sanitary equipments in the public places are mostly equipped with infrared sensors, so that, for example, the faucet, the soap dispenser and the flush button, all can be activated by the sensing of the users' hands without physical contacts. Therefore, not only the equipments can prolong their lifetime, the sanitary conditions also can be improved.

Although the electronic sensing technology brings in convenience for the sanitary equipments, it actually might turn up another problem of resource wasting if the design thereof is not good enough, especially for the automatic soap dispenser. Different from the electronic faucet or flush button which is activated as the hand is sensed and stopped as the hand leaves, namely the using time of the user decides the active duration of the equipments, if the automatic soap dispenser employs the same operation mode and stops the soap delivery as sensing the leaving of the user's hand, extra soap might be delivered out and dropped on the platform or the floor, so as to waste the soap and also increase the difficulty in cleaning.

Accordingly, the automatic soap dispenser is usually designed to supply a fixed amount of soap, as disclosed in R.O.C patent No. M328853, entitled "Soap dispensing mechanism for automatic soap dispenser", R.O.C patent No. M335262, entitled "Soap dispensing structure", and R.O.C patent No. M345577, entitled "Mechanism for doubling soap dispensing in automatic soap dispenser". All these disclosures employ a soap dispensing tube, and through compressing the soap dispensing tube, a fixed amount of soap can be outputted. However, a common issue of this kind of structure is that since the soap stored in the soap dispensing tube is not much, every time being triggered, the soap dispenser has to compress the tube several times for outputting a sufficient amount of soap. And, since the user is not aware of the multiple compressions and obviously has difficulty in ascertaining when the soap dispensing will stop, it is natural for the user to move the hand away after the first drop of soap and leave the sequential soap to drop on the platform or the floor. Besides, this kind of automatic soap dispenser always has a special packaging standard and also employs the dedicated soap container and dispensing tube, which limits the application thereof to other living wares, such as, shampoo, shower gel, or lotion.

In view of the drawbacks of the automatic soap dispenser described above, another kind of automatic soap dispenser is developed, as disclosed in R.O.C patent No. 367979, entitled "Vertical reciprocating pressing device", which can be applied to most containers with a pressing head in the markets, such as, the bottles of hand soap, shampoo, shower gel, or lotion. However, although this kind of soap dispenser can be widely used for various containers, it is disadvantageous that the pressing stroke can not be adjusted. For example, the pressing heads of different manufacturers employ different standards, e.g., for outputting sufficient soap, some are designed to press down a distance of 10 mm~14 mm, and others are 14 mm~20 mm. Therefore, as employing this kind of automatic soap disperser, one possibility is the output exceeds the required amount of soap and causes a soap wasting, and another possibility is the output is insufficient, so that the soap dispenser has to be set to press multiple times, and the problem of the unexpected drops of soap raises again.

Therefore, since the conventional soap dispenser with dispensing tube is deficient in insufficient delivering amount and poor compatibility with bottles in the market, and the conventional vertical reciprocating soap dispenser is also deficient in adjusting the pressing stroke and thus the output amount, there still a need to improve the structure of the soap dispenser.

SUMMARY OF THE INVENTION

The object of the present invention is to provide a pressing structure for a soap dispenser, which has high compatibility to various applications and provides different pressing strokes to meet requirements for different products, so as to output a sufficient liquid amount in single pressing.

For achieving the object described above, the present invention provides a pressing structure for a soap dispenser for adjusting an output amount of the soap that includes a rejecting member, a driving device, and a moving member, wherein the driving device is connected to the moving member through a transmission mechanism, and wherein the rejecting member includes a connecting portion linked with the moving member, and a pressing plate against a pressing head of a liquid container, and also, the rejecting member further includes a retractable portion which can be used to adjust the vertical distance between the connecting portion and the pressing plate, thereby configuring the basic architecture of the present invention. Moreover, the retractable portion can include a first frame body connected with the pressing plate, and a second frame body connected with the connecting portion, wherein the first frame body has a first top board, a first bottom board and two first side boards, and the second frame body has a second top board, a second bottom board and two second side boards; wherein the length of the second top board is shorter than that of the first top board, and the length of the second bottom board is shorter than the first bottom board, and further, the first bottom board has indentations corresponding to said two second side boards for achieving an assembling with the second frame body so as to form an adjusting space between the first bottom board and the second top board; and wherein the adjusting space further includes at least an elastic element, a position-limiting board and an adjusting element which is penetrated through the adjusting space and screwed with the position-limiting board.

Accordingly, as compared with the prior art, the present invention is advantageous of:

1. By employing the pressing plate to perform the vertical pressing movement, the present invention can be easily adapted to all kinds of common-used pressing bottles for, such as, hand soap, shampoo, shower gel and lotion, so that the user can have a wider selection without being restricted to the special pressing head.

2. Through adjusting the retractable portion of the present invention, the vertical distance between the pressing plate and the connecting portion can be varied, so that the vertical downward pressing distance of the pressing plate can be adjusted according to different standards of pressing heads, thereby providing a suitable amount of liquid soap.

3. According to the structure of the present invention, the soap dispenser can be easily adjusted to output a sufficient amount of soap in a single-time pressing, so as to prevent from pressing multiple times, which not only may confuse the user, but also will waste the soap if the user does not expect the sequential soap drop(s).

BRIEF DESCRIPTION OF THE DRAWINGS

The foregoing aspects and many of the attendant advantages of the present invention will be more readily appreciated as the same becomes better understood by reference to the following detailed description, when taken in conjunction with the accompanying drawings, wherein.

DESCRIPTION OF THE PREFERRED EMBODIMENT

Figure 1:
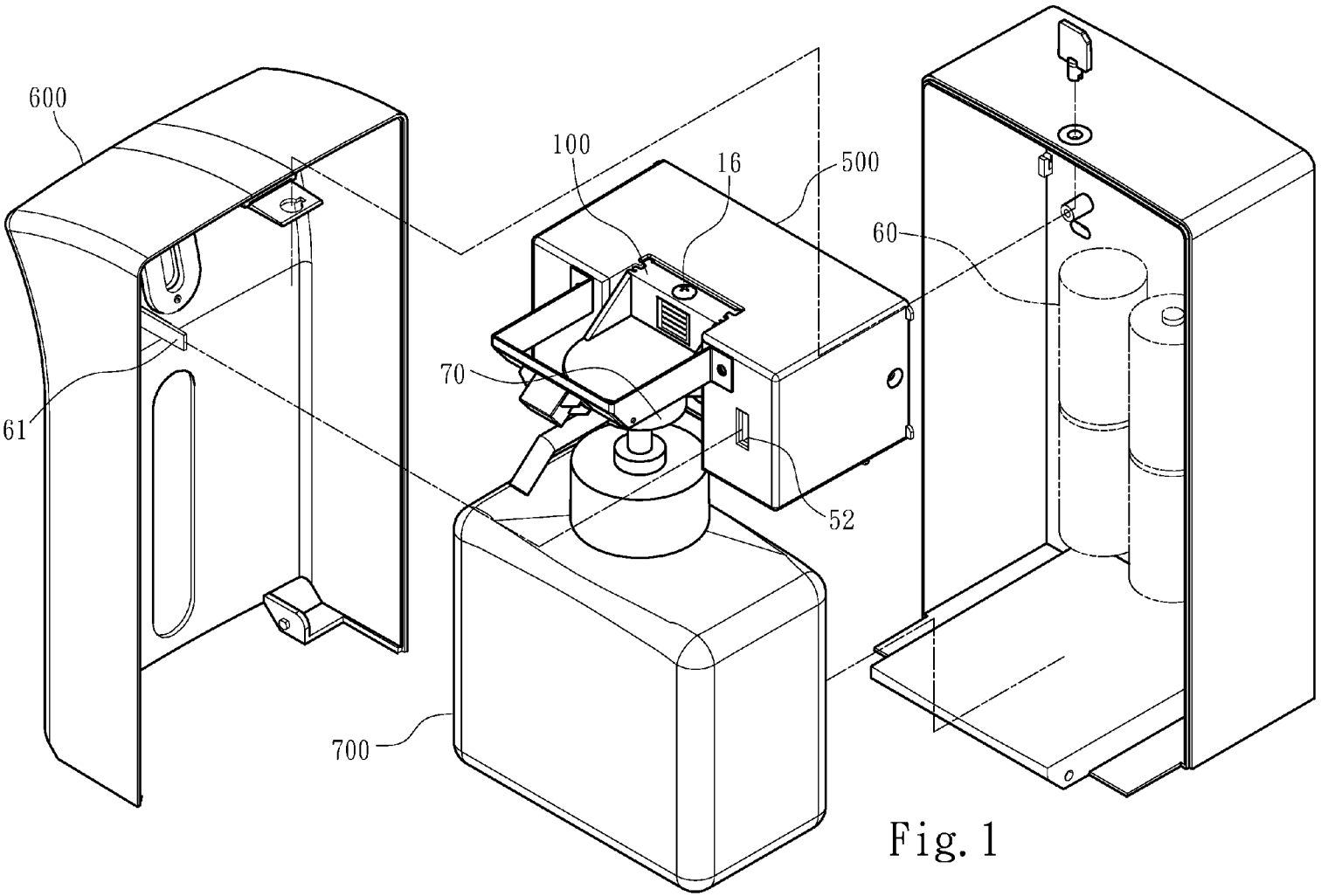
FIG. 1 is a schematic view showing the application of the present invention.
Figure 2:
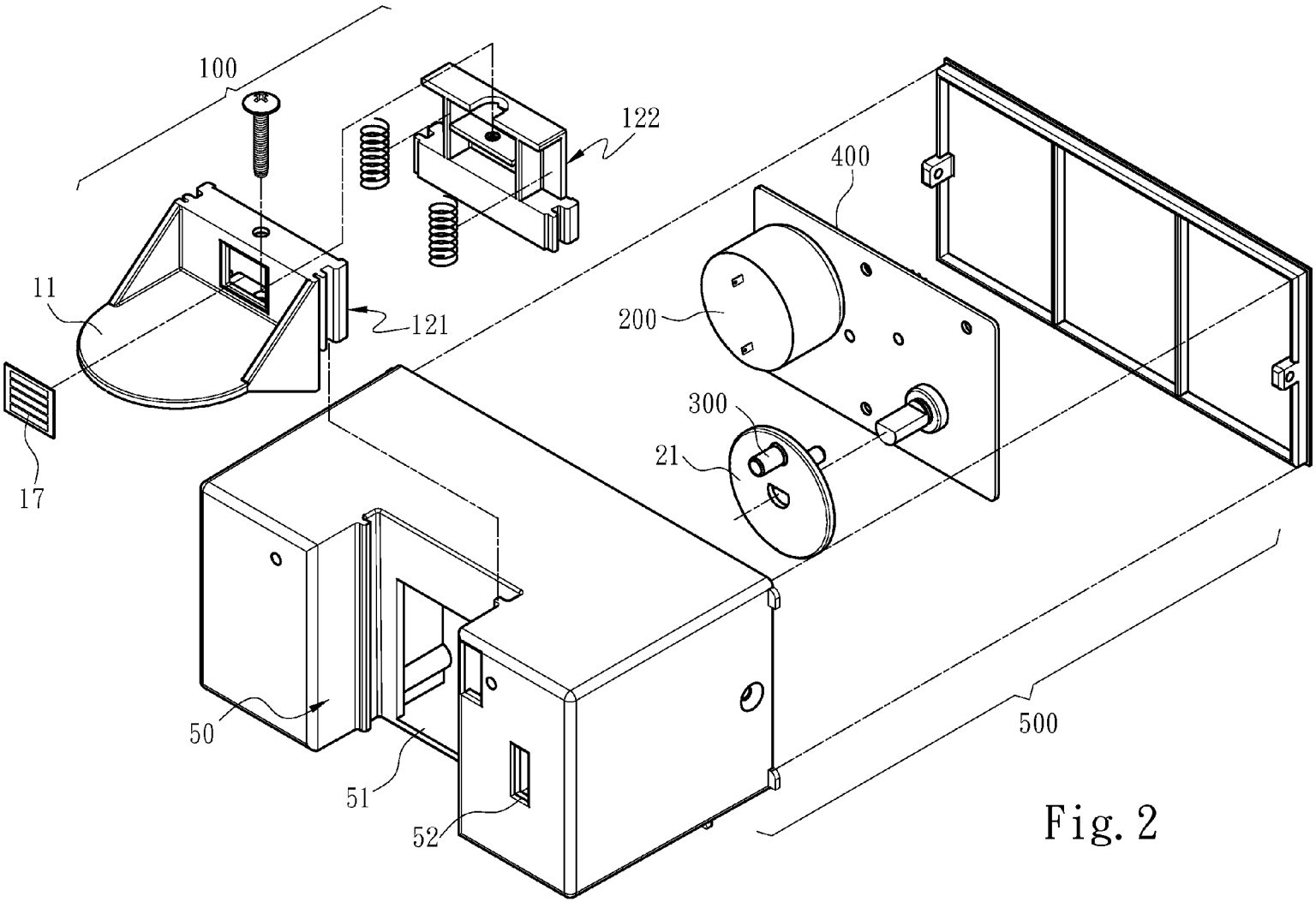
FIG. 2 is a first exploded view of the present invention.
Figure 3:
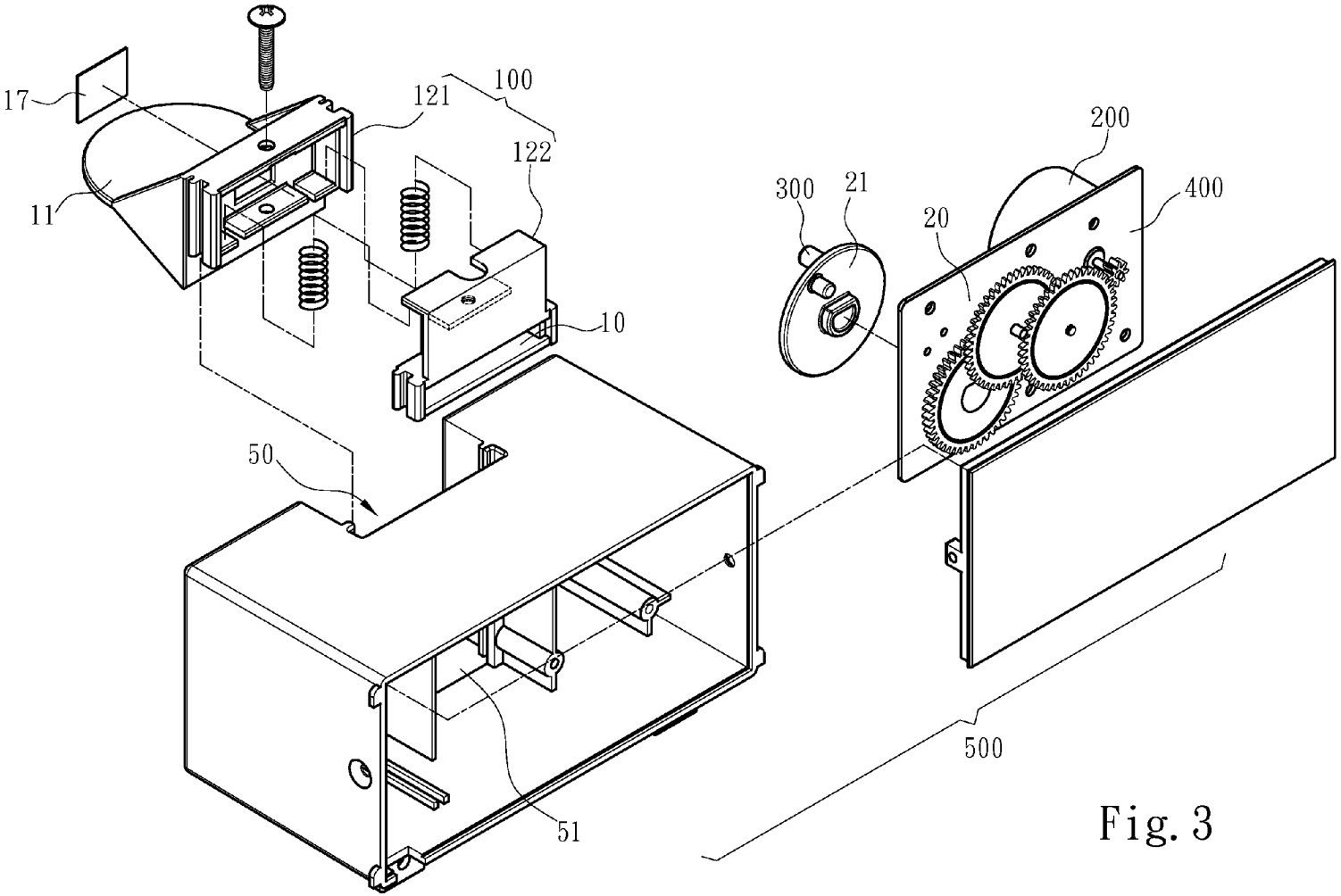
FIG. 3 is a second exploded view of the present invention.

Please refer to FIG. 1, FIG. 2 and FIG. 3, which are respectively a schematic view, a first exploded view and a second exploded view of the present invention. A pressing structure of a soap dispenser for adjusting an output amount of the soap is disclosed, including a rejecting member 100, a driving device 200, and a moving member 300, wherein the driving device 200 is connected to the moving member 300 through a transmission mechanism 20. The rejecting member 100 includes a connecting portion 10 linked with the moving member 300, and a pressing plate 11 against a pressing head 70 of a liquid container 700. It is characterized in that the rejecting member 100 further includes a retractable portion 12 (as shown in FIG. 5A) which can be used to adjust the vertical distance between the connecting portion 10 and the pressing plate 11.

Here, the driving device 200 and the transmission mechanism 20 are installed on a substrate 400. An inner housing 500 is further included to accommodate the driving device 200, the transmission mechanism 20 and the substrate 400, wherein the outer surface of the inner housing 500 has a sunken space 50 for connecting with the rejecting member 100, and the sunken space 50 has an opening 51 for penetrating the moving member 300, which connects the connecting portion 10 to the transmission mechanism 20. As shown, the connection between the sunken space 50 and the rejecting member 100 can be implemented to be a sliding track with a bulge, but not limited, for example, the sunken space 50 and the rejecting member 100 also can be connected in a manner of dovetail joint, so that the rejecting member 100 can have upward and downward movements in a vertical direction freely. Besides, as shown in the exemplary drawing, the moving member 300 can be a column mounted on a disc 21, which is driven to turn by the transmission mechanism 20, and the connecting portion 10 can have a groove for receiving the moving member 300.

Figure 4:
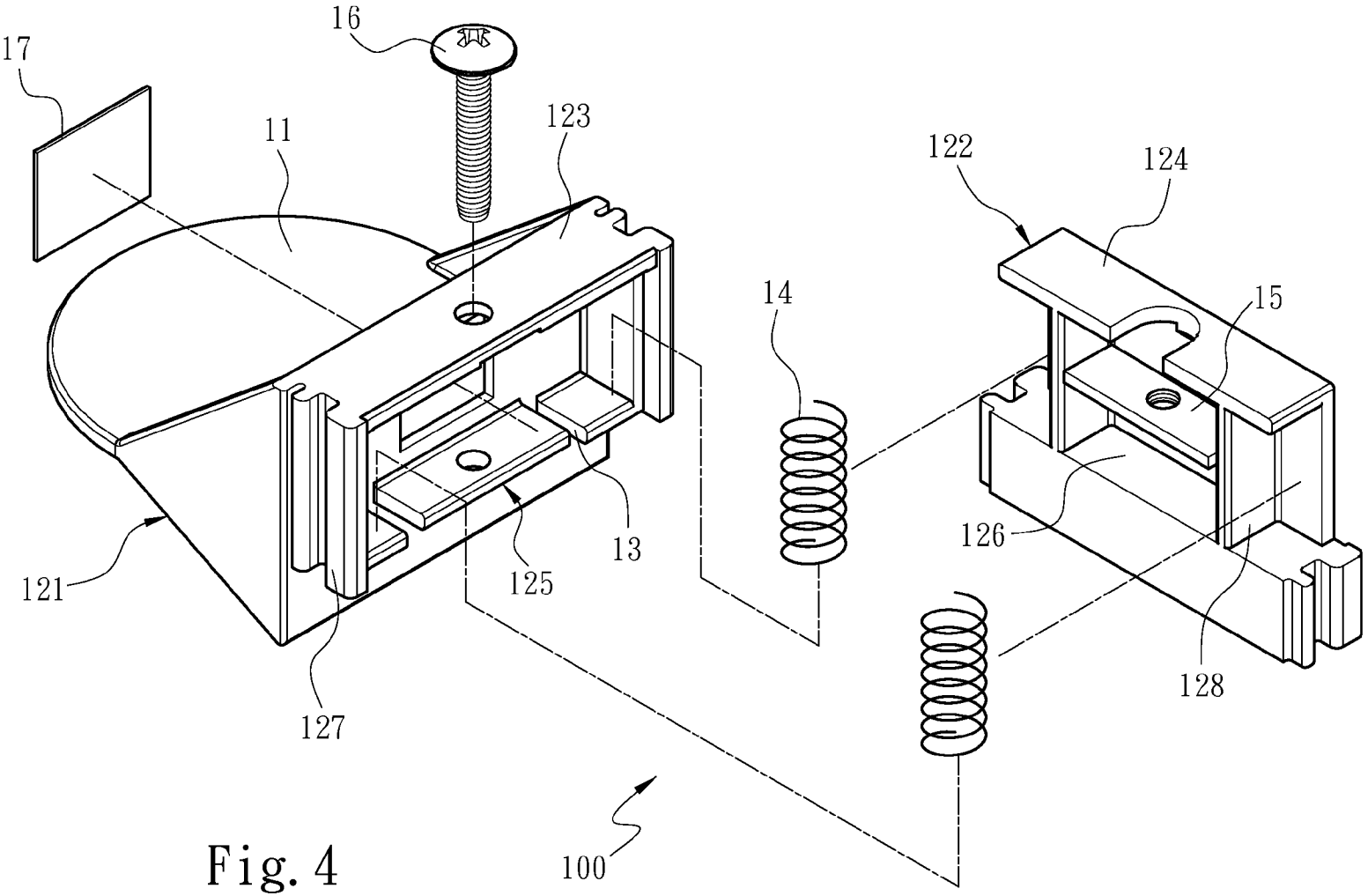
FIG. 4 is an exploded view of the rejecting member of the present invention.

Please further refer to FIG. 4, which is an exploded view of the rejecting member 100 of the present invention. The retractable portion 12 includes a first frame body 121 connected with the pressing plate 11, and a second frame body 122 connected with the connecting portion 10, wherein the first frame body 121 has a first top board 123, a first bottom board 125 and two first side boards 127 and the second frame body 122 has a second top board 124, a second bottom board 126 and two second side boards 128, and the length of the second top board 124 is shorter than that of the first top board 123, and the length of the second bottom board 126 is shorter than the first bottom board 125. Further, the first bottom board 125 has indentations 13 corresponding to said two second side boards 128, so that the first frame body 121 and the second frame body 122 can be assembled together to form an adjusting space between the first bottom board 125 and the second top board 124. Inside the adjusting space, it includes at least an elastic element 14, a position-limiting board 15 and an adjusting element 16, which is penetrated through the adjusting space and screwed with the position-limiting board 15. Besides, the first frame body 121 can further has a transparent window 17 mounted thereon, so as to enable the adjusting element 16 and the position-limiting board 15 to be visible.

Figure 5A:
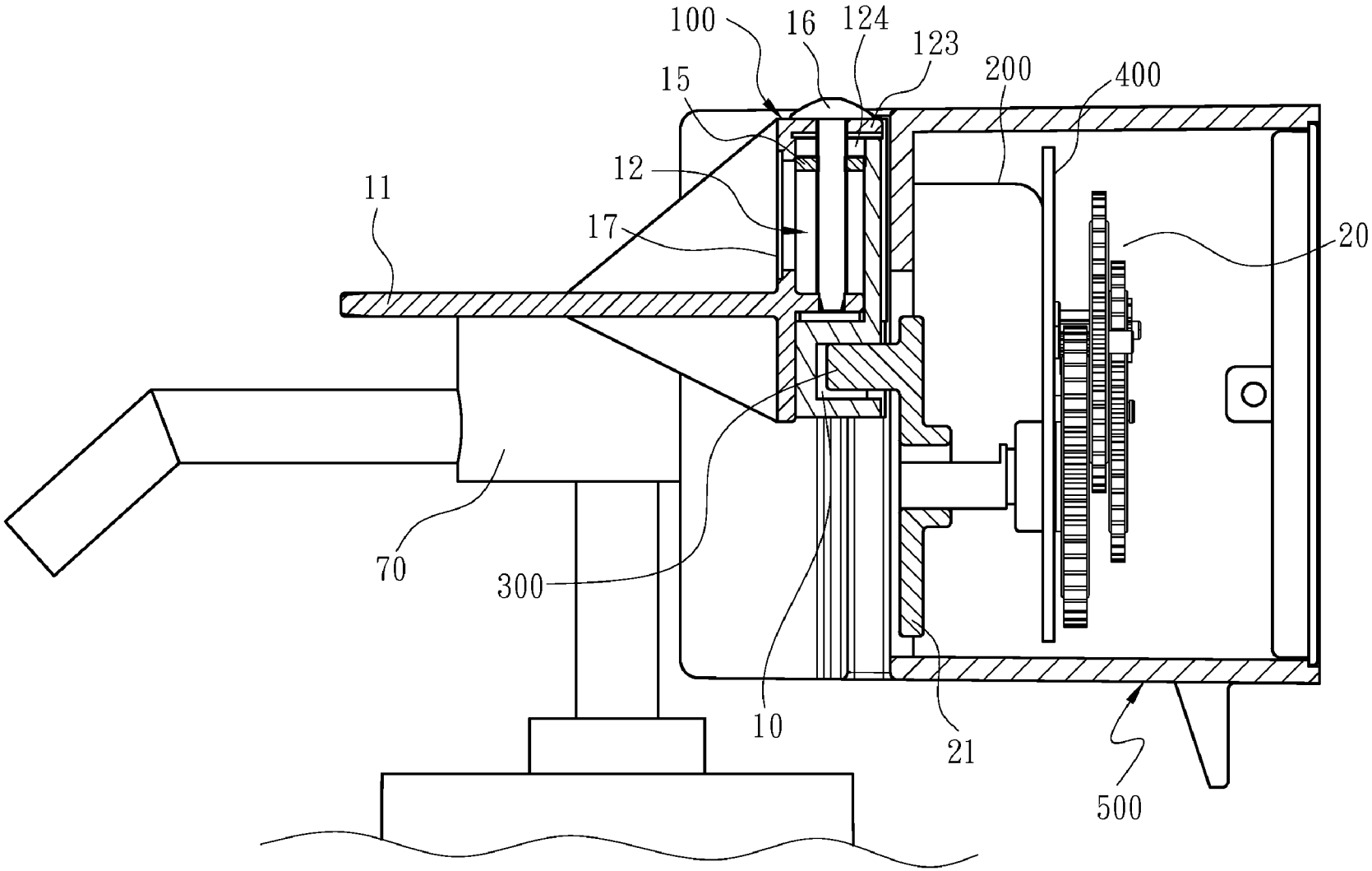
FIG. 5A is a schematic view showing a first condition for achieving the maximum pressing stroke of the pressing plate.
Figure 5B:
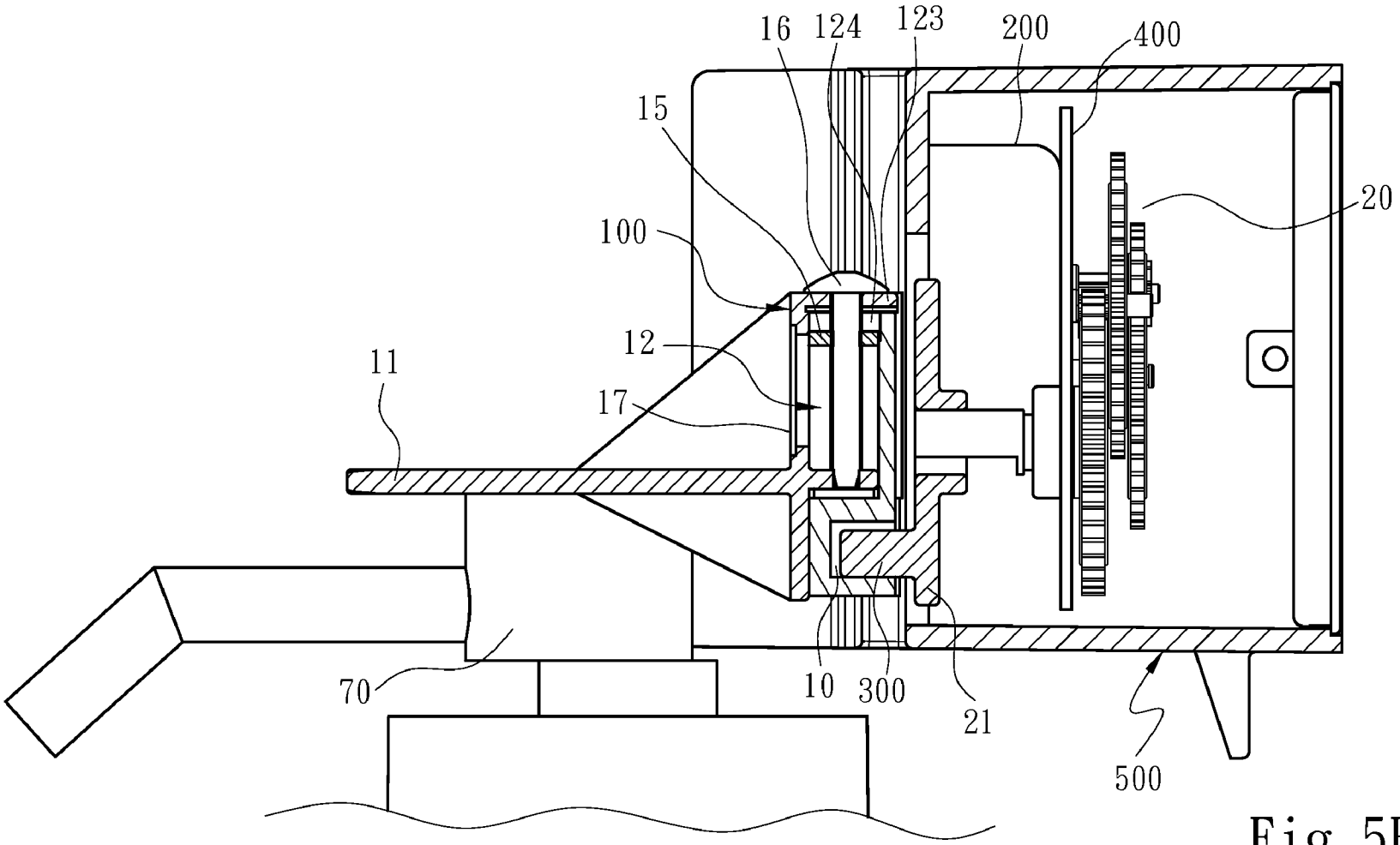
FIG. 5B is a schematic view showing a second condition for achieving the maximum pressing stroke of the pressing plate.

Please further refer to FIG. 5A, which is a schematic view showing a first condition for achieving the maximum pressing stroke of the pressing plate 11. As shown, through the transmission mechanism 20, the driving device 200 can jointly move the disc 21, and the moving member 300 on the disc 21 is connected with the connecting portion 10. In the exemplary drawing, the position-limiting board 15 is rejected against the second top board 124, so that the second top board 124 can closely contact with the first top board 123. Then, when the soap dispenser is activated by external signals, the driving device 200 generates a rotational energy to drive the transmission mechanism 20 to transmit kinetic energy, so as to turn the disc 21 and also the moving member 300. As a result, the connecting portion 10 and the second frame body 122 can be driven to move altogether. Here, since the second top board 124 is closely contacted with the first top board 123 through the position-limiting board 15, the first top board 123 also will be moved with the second top board 124. Sequentially, please refer to FIG. 5B, which is a schematic view showing a second condition for achieving the maximum pressing stroke of the pressing plate 11 after FIG. 5A. As shown, the vertical moving distance of the pressing plate 11 is identical to the vertical moving distance of the moving member 300. Here, the vertical moving distance of the moving member 300 is corresponding to the maximum vertical moving distance determined by the rotation of the disc 21 from the uppermost point to the lowermost point.

Figure 6A:
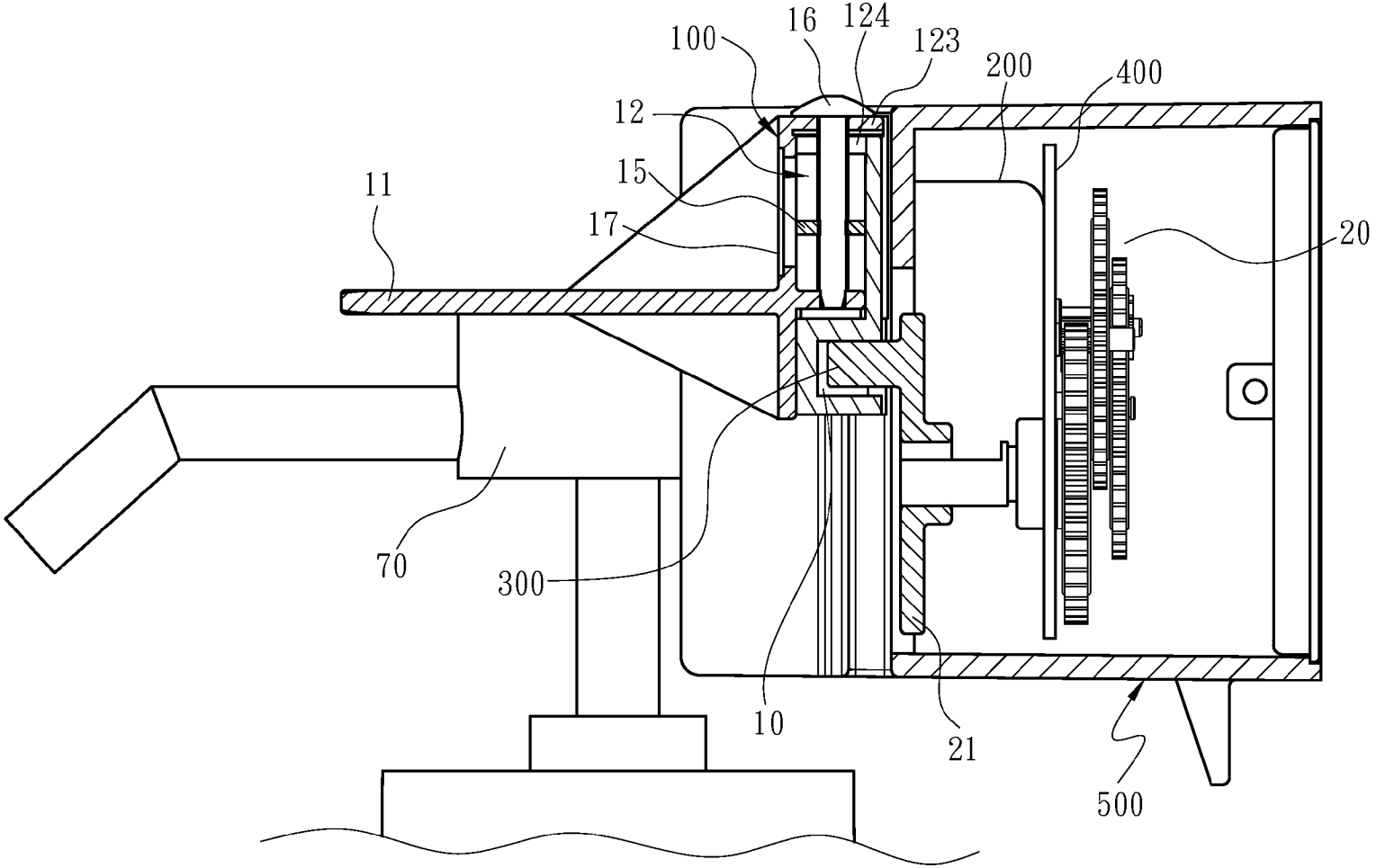
FIG. 6A is a schematic view showing a first condition for achieving a shorter pressing stroke of the pressing plate.
Figure 6B:
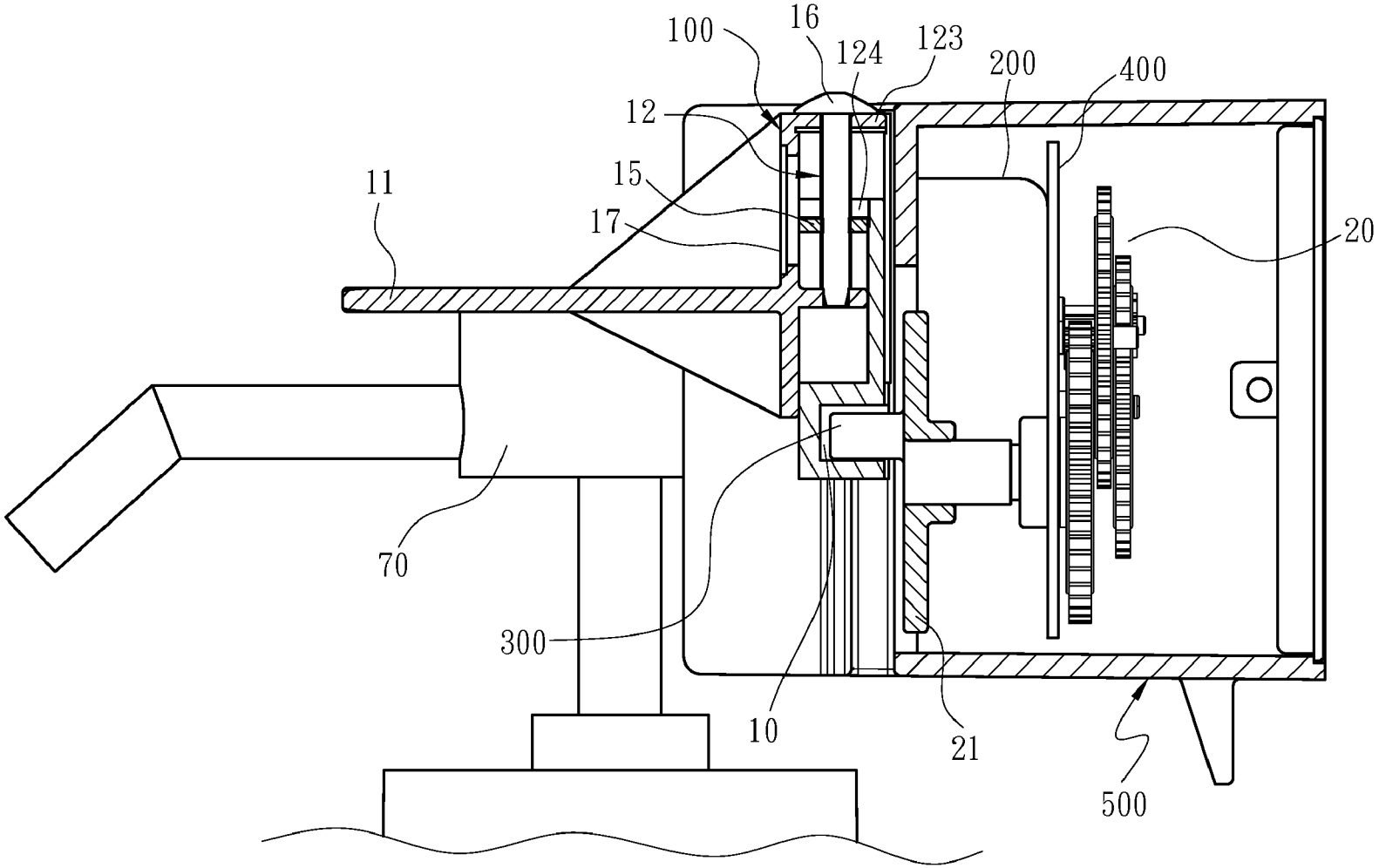
FIG. 6B is a schematic view showing a second condition for achieving a shorter pressing stroke of the pressing plate.
Figure 6C:
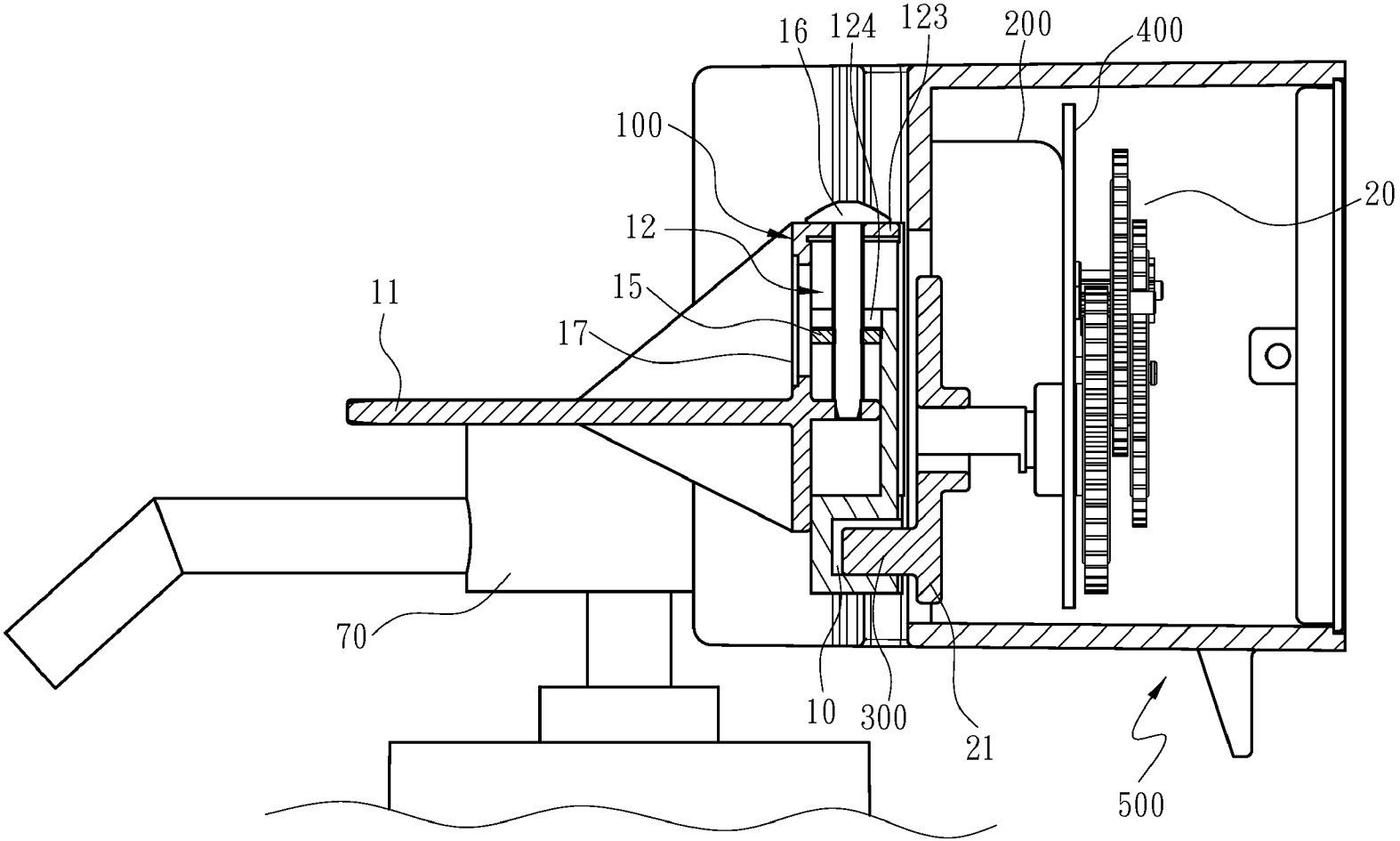
FIG. 6C is a schematic view showing a third condition for achieving a shorter pressing stroke of the pressing plate.

In addition to the maximum pressing stroke, the downward pressing distance of the pressing plate 11 also can be adjusted. Please refer to FIG. 6A, which is a schematic view showing a first condition for achieving a shorter pressing stroke of the pressing plate 11. As shown, by turning the adjusting element 16, the position-limiting board 15 can be moved downwardly to a position at the middle portion of the adjusting element 16 (as compared with FIG. 5A), and at this point, there is a distance remained between the position-limiting board 15 and the second top board 124. When the soap dispenser is activated by external signals, the driving device 200 generates the rotational energy to drive the transmission mechanism 20 to transmit the kinetic energy, so as to turn the disc 21 and also the moving member 300. As a result, the connecting portion 10 and the second frame body 122 can be driven to move altogether. Then, please refer to FIG. 6B, which is a schematic view showing a second condition for achieving a shorter pressing stroke of the pressing plate 11, since there is a distance remained between the second top board 124 and the position-limiting board 15, the pressing plate 11 will not be moved until the second top board 124 of the second frame body 122 is jointly moved to contact with the position-limiting board 15. Then, please refer to FIG. 6C, which is a schematic view showing a third condition for achieving a shorter pressing stroke of the pressing plate 11 after FIG. 6B. As shown, the second top board 124 has contacted with the position-limiting board 15, so that when the second top board 124 is jointly moved by the moving member 300, the first frame body 121 also will be moved to drive the downward movement of the pressing plate 11. Here, the moving distance of the pressing plate 11 is approximately equal to the maximum vertical moving distance of the moving member 300 minus the distance between the second top board 124 and position-limiting board 15, wherein the second top board 124 is closely contacted with the first top board 123.

In the aforesaid, according to the structure of the present invention, the downward pressing distance of the pressing plate 11 can be adjusted through varying the vertical position of the position-limiting board 15 by turning the adjusting element 16 to jointly move the position-limiting board 15 upward and downward, so that the present invention can be easily adapted to various pressing heads 70 of different liquid containers 700 for outputting a sufficient amount of liquid in a single pressing of the pressing plate 11.

Although the present invention is described by the preferred embodiments above, it is not limited thereby. Please refer to FIG. 1, an outer housing 600 can be further included to accommodate the inner housing 500 and the liquid container 700, and a power supplying unit 60 also can be mounted in the outer housing 600 for supplying the driving device 200. Moreover, in considering of the power security, a contact element 61 can be further mounted in the outer housing 600 and a detecting hole 52 corresponding thereto can be mounted on the inner housing 500, and the detecting hole 52 can achieve a detecting function by installing a micro switch.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pressing structure of a soap dispenser for adjusting an output amount of the soap, including a rejecting member, a driving device, and a moving member, wherein the driving device is connected to the moving member through a transmission mechanism, and the rejecting member includes a connecting portion linked with the moving member, and a pressing plate against a pressing head of a liquid container, characterized in that:

the rejecting member further includes a retractable portion used for adjusting the vertical distance between the connecting portion and the pressing plate, and the retractable portion includes a first frame body connected with the pressing plate, and a second frame body connected with the connecting portion, wherein the first frame body has a first top board, a first bottom board and two first side boards, and the second frame body has a second top board, a second bottom board and two second side boards; wherein the length of the second top board is shorter than that of the first top board, and the length of the second bottom board is shorter than the first bottom board, and further, the first bottom board has indentations corresponding to said two second side boards for assembling the first frame body with the second frame body so as to form an adjusting space between the first bottom board and the second top board; and wherein the adjusting space further includes at least an elastic element, a position-limiting board and an adjusting element which is penetrated through the adjusting space and screwed with the position-limiting board.

2. The structure as claimed in claim 1, wherein the first frame body further has a transparent window mounted thereon, so as to enable the adjusting element and the position-limiting board to be visible.

3. The structure as claimed in claim 1, wherein the driving device and the transmission mechanism are installed on a substrate.

4. The structure as claimed in claim 3, further including an inner housing to accommodate the driving device, the transmission mechanism and the substrate, wherein an outer surface of the inner housing has a sunken space for connecting with the rejecting member, and the sunken space has an opening for penetrating the moving member to connect the connecting portion with the transmission mechanism.

5. The structure as claimed in claim 4, wherein the connection between the sunken space and the rejecting member is implemented to be a sliding track with a bulge, or a dovetail joint.

6. The structure as claimed in claim 1, wherein the moving member is implemented as a column mounted on a disc, which is driven to turn by the transmission mechanism, and the connecting portion is implemented to have a groove for receiving the moving member.

* * * * *